US011372349B2

(12) United States Patent
Kato

(10) Patent No.: US 11,372,349 B2
(45) Date of Patent: Jun. 28, 2022

(54) DEVELOPING DEVICE WITH AIR CIRCULATION

(71) Applicant: Hewlett-Packard Development Company, L.P., Spring, TX (US)

(72) Inventor: Yuya Kato, Yokohama (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/299,769

(22) PCT Filed: Jun. 10, 2020

(86) PCT No.: PCT/US2020/036938
§ 371 (c)(1),
(2) Date: Jun. 3, 2021

(87) PCT Pub. No.: WO2020/251982
PCT Pub. Date: Dec. 17, 2020

(65) Prior Publication Data

US 2022/0121139 A1 Apr. 21, 2022

(30) Foreign Application Priority Data

Jun. 14, 2019 (JP) ..... JP2019-111172

(51) Int. Cl.

| | |
|---|---|
| ***G03G 15/08*** | (2006.01) |
| ***G03G 15/09*** | (2006.01) |
| ***G03G 21/00*** | (2006.01) |
| ***G03G 21/20*** | (2006.01) |

(52) U.S. Cl.
CPC ..... *G03G 15/0898* (2013.01); *G03G 15/0865* (2013.01); *G03G 15/0942* (2013.01); *G03G 21/0052* (2013.01); *G03G 21/206* (2013.01)

(58) Field of Classification Search
CPC ..... G03G 15/0865; G03G 15/0898; G03G 15/0942; G03G 21/0052; G03G 21/206
See application file for complete search history.

(56) References Cited

U.S. PATENT DOCUMENTS

| | | | | |
|---|---|---|---|---|
| 7,149,453 | B2 | 12/2006 | Fujita | |
| 10,859,975 | B2 * | 12/2020 | Omura | G03G 21/0052 |
| 10,877,400 | B1 * | 12/2020 | Kuramoto | G03G 21/206 |

(Continued)

FOREIGN PATENT DOCUMENTS

| | | | |
|---|---|---|---|
| CN | 1619432 | A | 5/2005 |
| CN | 106019912 | A | 10/2016 |
| GB | 1460154 | A | 12/1976 |

(Continued)

*Primary Examiner* — Sophia S Chen
(74) *Attorney, Agent, or Firm* — Jefferson IP Law, LLP

(57) ABSTRACT

A developing device includes a container having an opening, a developer roller disposed within the container to supply toner to a photosensitive body through the opening, and an air flow passage. The air flow passage receives air from inside of the container and supplies the air, via an end of the container in a longitudinal direction of the developer roller, to an upstream side, in a rotation direction of the developer roller, of a closest position between the developer roller and the photosensitive body. The air flow passage has an outlet that is aligned with a central area in the longitudinal direction of the developer roller.

15 Claims, 9 Drawing Sheets

(56) References Cited

U.S. PATENT DOCUMENTS

2019/0025730 A1* 1/2019 Akaike ..... G03G 21/206

FOREIGN PATENT DOCUMENTS

| | | | |
|---|---|---|---|
| JP | 1998171244 | A | 12/1996 |
| JP | 2002214986 | A | 7/2002 |
| JP | 2011095646 | A | 5/2011 |
| JP | 2011203658 | A | 10/2011 |
| JP | 2016156846 | A | 9/2016 |

* cited by examiner (a)

(b)

DEVELOPING DEVICE WITH AIR CIRCULATION

BACKGROUND

Image forming apparatus such as a printer, may include a developing device to develop toner images. During operation of the developing device, a developer roller housed in a container, is rotated while carrying developer, and supplies toner to a photosensitive drum through an opening of the container. During to the rotation of the developer roller, air contained in a developer carried on the developer roller may be drawn into the container.

BRIEF DESCRIPTION OF DRAWINGS

FIG. 4 part (b) is a schematic perspective view of the flow passage member of FIG. 4 part (a), illustrated with an example layer regulation member.

FIG. 5 part (b) is a schematic perspective view of the flow passage member of FIG. 5 part (a), illustrated with an example layer regulation member.

FIG. 6 part (b) is a schematic diagram of another example flow passage member.

DETAILED DESCRIPTION

In the following description, with reference to the drawings, the same reference numbers are assigned to the same components or to similar components having the same function, and overlapping description is omitted.

Figure 1:
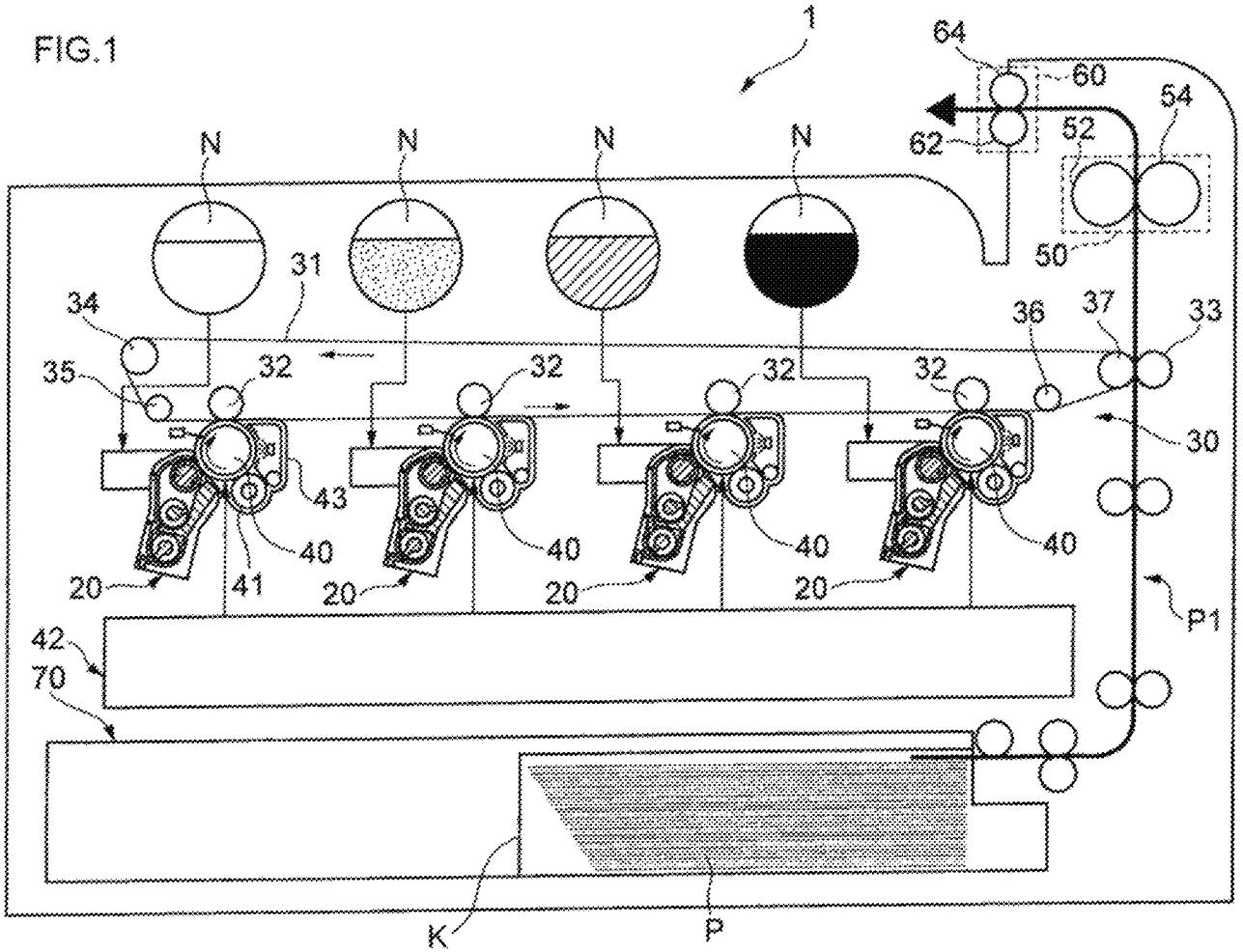
FIG. 1 is a schematic diagram of an example image forming apparatus including an example developing device.

FIG. 1 illustrates an example image forming apparatus 1 including an example developing device.

The example image forming apparatus 1 includes, for each of four toner colors (magenta, yellow, cyan and black), a toner bottle N, a developing device 20, a photosensitive drum 40, a charge roller 41, and a cleaning unit 43. Throughout the description, it is appreciated that the toner bottle N may be interpreted as one or more of the toner bottles with magenta, yellow, cyan, and black toners, the developing device 20 as one or more of the developer devices associated with the magenta, yellow, cyan, and black toners, the photosensitive drum 40 as one or more of the photosensitive drums associated with the magenta, yellow, cyan, and black toners, the charge roller 41 as one or more of the charge rollers associated with the magenta, yellow, cyan, and black toners, and the cleaning unit 43 as one or more of the cleaning units associated with the magenta, yellow, cyan, and black toner. The image forming apparatus 1 also includes a recording medium transport unit 70, a transfer device 30, an exposure unit 42, a fixing device 50, and a discharge device 60. The transfer device 30 includes an intermediate transfer belt 31, support rollers 34, 35, 36 and 37 for supporting the intermediate transfer belt 31 to allow a circulating movement, four primary transfer rollers 32 each corresponding to the four photosensitive drums 40, and a secondary transfer roller 33 that is rotated to follow the movement of the intermediate transfer belt 31 while pressing a sheet of paper P onto the intermediate transfer belt 31. It is also appreciated that the primary transfer roller 32 may be interpreted as one or more of the transfer rollers associated with the magenta, yellow, cyan, and black toners. The support roller 37 may include a drive roller for circularly moving (driving) the intermediate transfer belt 31 in a direction indicated by arrows.

Each photosensitive drum 40 is charged by the associated charge roller 41. An electrostatic latent image is formed on the photosensitive drum 40 by using the exposure unit 42, according to image data of the corresponding color. The developing device 20 associated with the photosensitive drum 40 develops the electrostatic latent image with toner from the corresponding toner bottle N, to form a toner image on the photosensitive drum 40. The four color toner images respectively formed on the four photosensitive drums 40 are then successively overlaid on the intermediate transfer belt 31 by the primary transfer roller 32 to be combined into a single composite toner image. The composite toner image on the intermediate transfer belt 31 is then transferred onto the sheet of paper P by the secondary transfer roller 33, and fixed onto the sheet of paper P by the fixing device 50 which includes a heating roller 52 and a pressure roller 54. The sheets of paper P are transported one at a time, by the recording medium transport unit 70 from a cassette K along a transport passage P1, and are discharged from the discharge device 60 which include discharge rollers 62, 64 after receiving transfer of the toner image by the secondary transfer roller 33.

Figure 2:
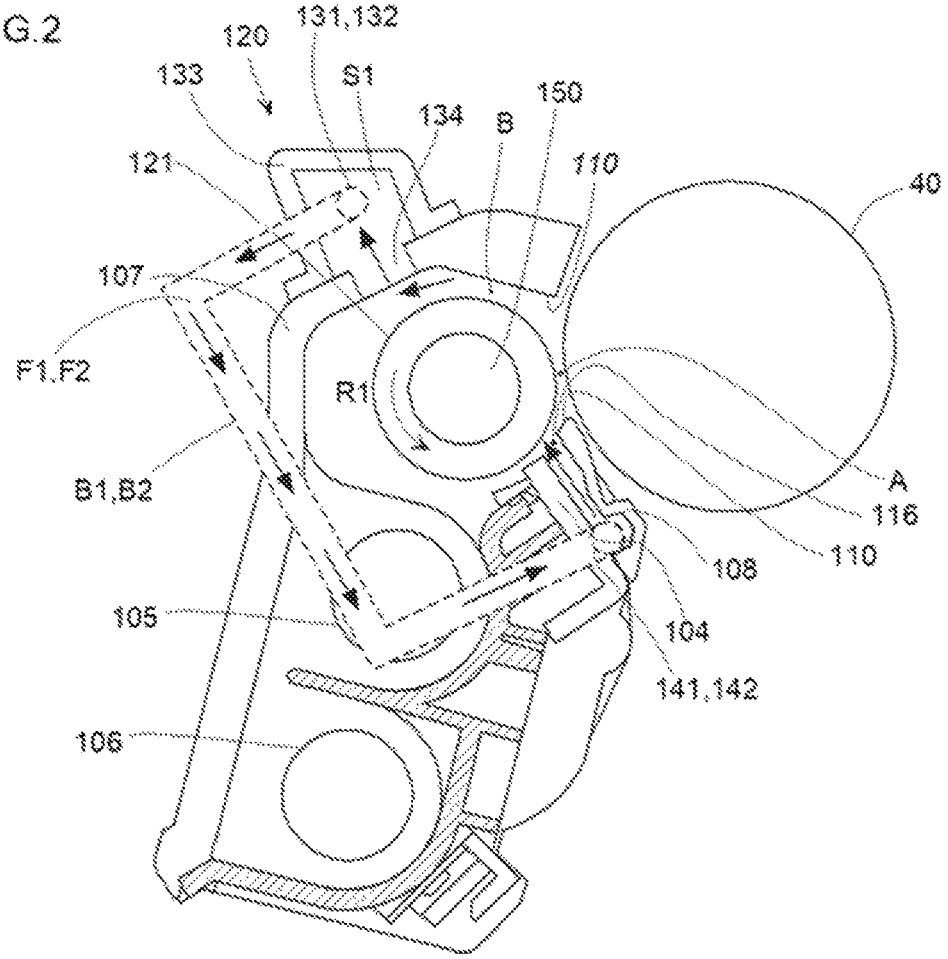
FIG. 2 is a schematic cross-sectional view of an example developing device.
Figure 3:
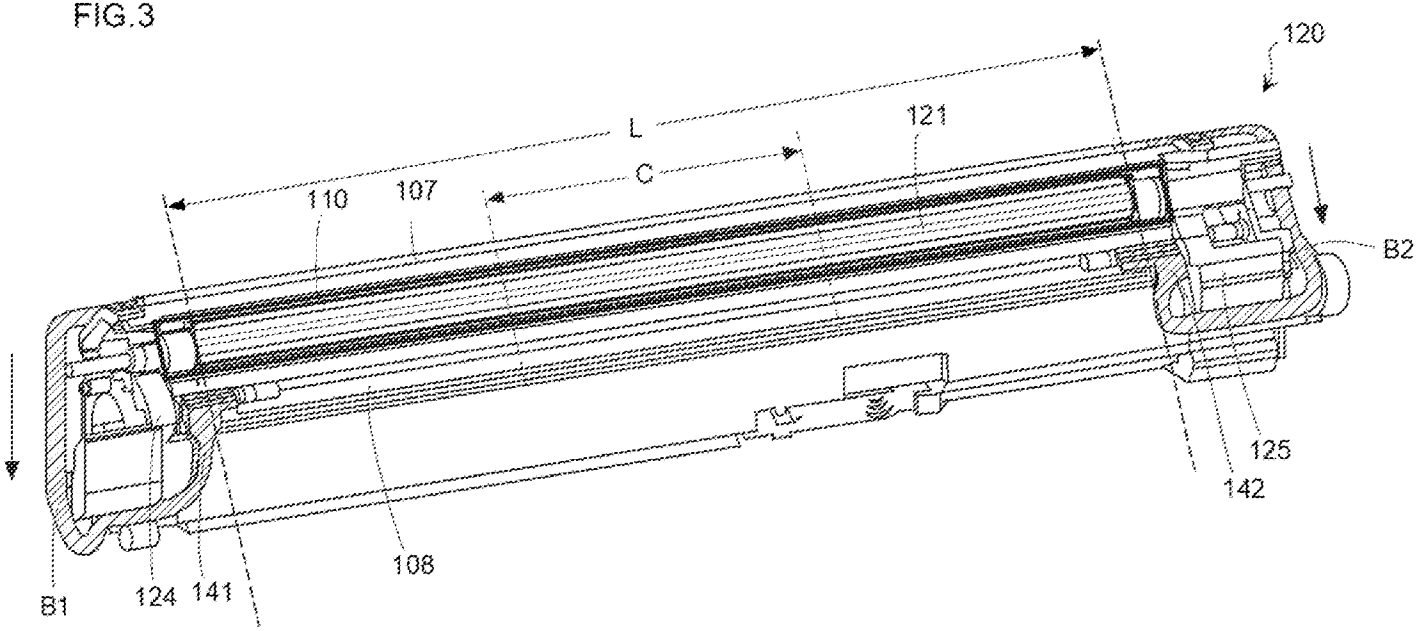
FIG. 3 is a schematic perspective view of the example developing device shown in FIG. 2.

FIG. 2 shows an example developing device 120 with air circulation, disposed close to the photosensitive drum 40, according to an example. The developing device 120 includes a container 107 having an opening 110 and a developer roller 121 disposed within the container 107 to supply toner to the photosensitive drum 40 through the opening 110. FIG. 3 is a perspective view of the developing device 120.

With reference to FIGS. 2 and 3, the example developing device 120 includes a first air flow passage F1 and a second air flow passage F2. The first air flow passage F1 receives air via an inlet located on the inside of the container 107 and supplies the air via a first end 124 of the container 107 in a longitudinal direction of the developer roller 121, to an outlet located at an upstream side of a closest position A between the developer roller 121 and the photosensitive drum 40 (hereinafter referred to as "upstream side of the position A"), in a rotation direction R1 of the developer roller 121. The second air flow passage F2 receives air via an inlet located inside of the container 107 and supplies the air via a second end 125 of the container 107 in the longitudinal direction of the developer roller 121, to an outlet located at an upstream side of the position A, in a rotation direction R1 of the developer roller 121. The first and second air flow passages F1, F2 are shown in shaded areas in FIG. 3.

During an operation of the developing device 120, stir-and-transport members 105 and 106 stir the developer, which may include magnetic carrier and nonmagnetic toner, in the container 107 and charge the developer by friction. In some examples, the stir-and-transport members 105 and 106 may include two parallel screws or augers for stirring and transporting the developer in mutually opposite directions. The developer roller 121 includes a magnet 150 therein, and adsorbs the charged developer to the outer peripheral surface of the developer roller 121 by a magnetic force. The developer roller 121 is rotated while carrying the developer, and supplies the toner to the photosensitive drum 40 through the opening 110 of the container 107. Due to the rotation of the developer roller 121, air contained in a developer carried on the developer roller 121 may be taken into the container 107, and the internal pressure of the container 107 may rise. When the internal pressure of the container rises in image forming apparatuses of comparative examples, part of the toner may leak from the container 107 and scatter to various parts in the housing of the image forming apparatus which may lead to toner contamination inside of the housing. For example, the toner may leak from the gap formed between the opening of the container and the developer roller, and/or through the ends of the developer roller or container which are leaky (e.g., less airtight) via the ADR outlet, etc. In the example developing device 120, the first and second air flow passages F1 and F2 may suppress an increase of the internal pressure of the container 107 by returning the pressurized air to the outlet located at an upstream side of the position A, from the inside of the container 107.

In some examples, the container 107 includes an elongated cover 133 attached to an outer surface of the container 107 to define an exhaust duct S1. The exhaust duct S1 is communicated with the inside of the container 107 through one or more holes 134 formed in the container 107. The first air flow passage F1 includes the exhaust duct S1 and a first bypass passage B1 extending from the exhaust duct S1 through the first end 124 of the container 107 to a flow passage member (or a flow passage forming member) 108. The second air flow passage F2 includes the exhaust duct S1 and a second bypass passage B2 extending from the exhaust duct S1 through the second end 125 of the container 107 to the flow passage member 108. The hole(s) 134 form inlets to the first air flow passage F1 and to the second air flow passage F2. An inlet 131 of the first bypass passage B1 is coupled to the exhaust duct S1 through a hole formed at one longitudinal end (a first longitudinal end) of the cover 133, and an inlet 132 of the second bypass passage B2 is coupled to the exhaust duct S1 through a hole formed at the other longitudinal end (a second longitudinal end) of the cover 133. An outlet 141 of the first bypass passage B1 is coupled to one end (a first end) of the flow passage member 108, and an outlet 142 of the second bypass passage B2 is coupled to the other end (a second end) of the flow passage member 108. FIG. 2 shows the first and second bypass passages B1 and B2 in a simplified schematic form, to schematically illustrate the function of the circulation passage.

The developing device 120 includes the two air flow passages F1 and F2 to reduce the thickness (e.g., the cross-sectional area of the internal space) per one passage of the bypass passages B1 and B2, and to reduce the size of (e.g., to downsize) the developing device 120. In some examples, the developing device 120 may be provided with a single one of the air flow passages F1 and F2.

The example developing device 120 includes a layer regulation member 104 that is spaced apart from the developer roller 121 to form a gap (e.g., a predetermined gap) with an outer peripheral surface of the developer roller 121. The layer regulation member 104 may be located at an upstream side of the position A and close to the opening 110. The layer regulation member 104 controls the thickness of the layer of the developer carried on the outer peripheral surface of the developer roller 121 to be a predetermined thickness that corresponds to the gap.

The inlet of the first air flow passage F1 (e.g., the hole 134) may be provided at a downstream side, in the rotation direction R1 of the developer roller 121, of a closest position B between the developer roller 121 and the inner wall of the container 107 (hereinafter referred to as "downstream side of the position B"), and at an upstream side, in the rotation direction R1 of the developer roller 121, of the layer regulation member 104 (hereinafter referred to as "upstream side of the layer regulation member 104"). Similarly, the inlet of the second air flow passage F2 (e.g., the hole 134) may be located at a downstream side of the position B and at an upstream side of the layer regulation member 104. By providing the inlets (e.g., the hole 134) of the first and second air flow passages F1 and F2 at such positions, the air may be drawn out from a relatively high pressure area in the container 107, and thus, the internal pressure of the container 107 can be effectively reduced.

Depending on the position to which the air is returned, simply returning the air to the upstream side of the position A may cause part of the air returned to flow to less airtight end(s) of the developer roller 121, thus causing a trace amount of toner contained in such air to contaminate the end(s) of the developer roller 121 or the end(s) of the photosensitive drum 40.

Accordingly, the developing device 120 includes the example flow passage member 108 described below, to allow passage of the air drawn out from the inside of the container 107 to the upstream side of the position A through each of the first and second bypass passages B1 and B2, and to supply the air to a central area C along the longitudinal direction of the developer roller 121. Accordingly, in the developing device 120, the developer roller 121 collects substantially all of the air returned to the upstream side of the position A before the air reaches the end of the developer roller 121, to prevent or inhibit the aforementioned toner contamination at the end(s) of the developer roller 121 or the end(s) of the photosensitive drum 40.

Figure 4:
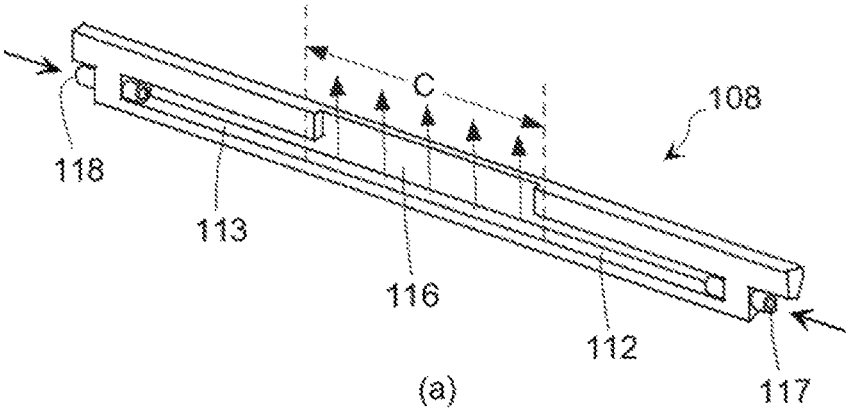
FIG. 4 part (a) is a schematic perspective view of an example flow passage member.
Figure 4:
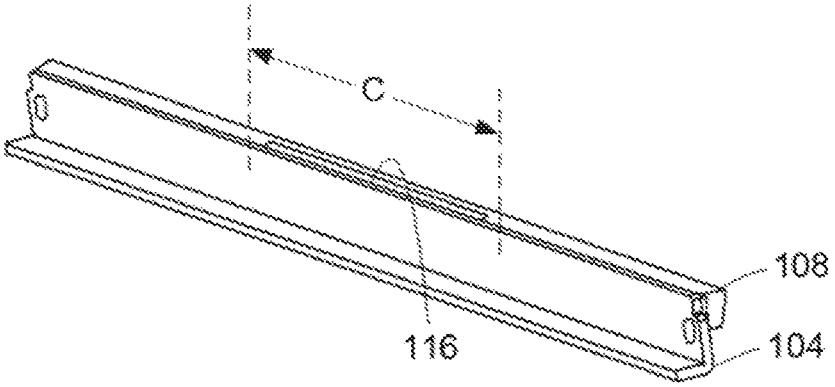

With reference to FIGS. 4(*a*) and 4(*b*), an example flow passage member (or flow passage forming member) 108 is coupled to the layer regulation member 104 in the container 107 to form a first outlet passage 112 and a second outlet passage 113 between the layer regulation member 104 and the flow passage member 108. With further reference to FIGS. 2 and 3, an inlet 117 of the first outlet passage 112 is coupled to the outlet 141 of the first bypass passage B1, and an inlet 118 of the second outlet passage 113 is coupled to the outlet 142 of the second bypass passage B2.

The first outlet passage 112 conducts, to an outlet 116, the air supplied from the inside of the container 107 to the inlet 117 via the first bypass passage B1. The second outlet passage 113 conducts, to the outlet 116, the air supplied from the inside of the container 107 to the inlet 118 via the second bypass passage B2. The first air flow passage F1 includes the first outlet passage 112 communicated with the outlet 141 of the first bypass passage B1. The second air flow passage F2 includes the second outlet passage 113 communicated with the outlet 142 of the second bypass passage B2. In some examples, the outlet of the first air flow passage F1 and the outlet of the second air flow passage F2 are formed as a common outlet 116. The outlet 116 opens toward the developer roller 121 at an angle substantially vertical to the longitudinal direction of the developer roller 121.

In the example developing device 120, the outlet 116 is provided within the central area C in the longitudinal direction of the developer roller 121 to cause the developer roller 121 to collect substantially all of the air returned to the upstream side of the position A (e.g., in a space adjacent the developer roller 121) before the air reaches the end(s) of the developer roller 121. Thus, this may prevent or inhibit the aforementioned toner contamination at the end(s) of the developer roller 121 or at the end(s) of the photosensitive drum 40. To further prevent or inhibit the toner contamination, the central area C may have a width in the longitudinal direction of the developer roller 121, corresponding to one third of the total length L of the developer roller 121 in the longitudinal direction. In some examples, the width may extend along a quarter of the total length L of the developer roller 121 in the longitudinal direction of the developer roller 121.

The total length L of the developer roller 121 may refer to the total length of the image forming area in the longitudinal direction of the developer roller 121 (the developer holding area excluding the margin area at both ends). The outlet 116 may be positioned entirely within the central area C in the longitudinal direction of the developer roller 121.

The outlet 116 may be located at the upstream side of the position A and at the downstream side of the layer regulation member 104, in order to more efficiently collect scattered toner contained in the air supplied to the central area C through the first and second air flow passages F1 and F2. In the flow passage member 108, the outlet 116 is common to the two air flow passages F1 and F2. In some examples, the outlet of the first air flow passage F1 and the outlet of the second air flow passage F2 may be formed as separate outlets. In this case, each of the outlet of the first air flow passage F1 and the outlet of the second air flow passage F2 may be located at the central area C in the longitudinal direction of the developer roller 121. Each of the outlet of the first air flow passage F1 and the outlet of the second air flow passage F2 may be positioned entirely within the central area C in the longitudinal direction of the developer roller 121.

Figure 5:
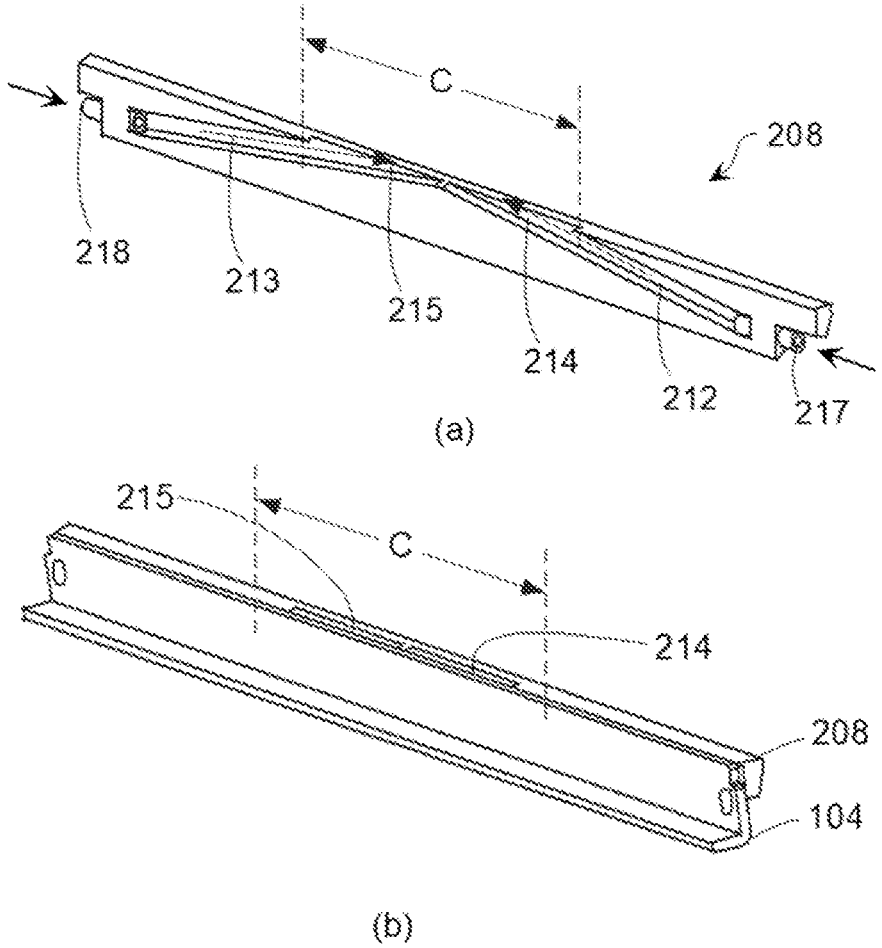
FIG. 5 part (a) is a schematic perspective view of an example flow passage member.

For example, with reference to FIGS. 5(*a*) and 5(*b*), the example developing device 120 may include a flow passage member (or a flow passage forming member) 208. The example flow passage member 208 is coupled to the layer regulation member 104 in the container 107 to form a first outlet passage 212 and a second outlet passage 213. An inlet 217 of the first outlet passage 212 is coupled to the outlet 141 of the first bypass passage B1, and an inlet 218 of the second outlet passage 213 is coupled to the outlet 142 of the second bypass passage B2.

The first outlet passage 212 conducts, to a first outlet 214, the air supplied from the inside of the container 107 to the inlet 217 via the first bypass passage B1. The second outlet passage 213 conducts, to a second outlet 215, the air supplied from the inside of the container 107 to the inlet 218 via the second bypass passage B2. The first air flow passage F1 includes the first outlet passage 212 communicated with the outlet 141 of the first bypass passage B1. The second air flow passage F2 includes a second outlet passage 213 communicated with the outlet 142 of the second bypass passage B2. Namely, the outlet of the first air flow passage F1 and the outlet of the second air flow passage F2 are formed as separate first and second outlets 214, 215.

In the developing device 120, each of the first and second outlets 214, 215 may be provided at the central area C in the longitudinal direction of the developer roller 121 to cause the developer roller 121 to collect substantially all of the air returned to the upstream side of the position A (e.g., in a space adjacent the developer roller 121) before the air reaches the end(s) of the developer roller 121, and thus can prevent or inhibit the aforementioned toner contamination at the end(s) of the developer roller 121 or at the end(s) of the photosensitive drum 40. The first and second outlets 214 and 215 may be positioned entirely within the central area C in the longitudinal direction of the developer roller 121.

Each of the first and second outlets 214 and 215 is opened toward the developer roller 121 at an angle inclined, from an angle perpendicular to the longitudinal direction of the developer roller 121, toward a center in the longitudinal direction of the developer roller 121. This may increase the angle of change in direction when the air supplied from each of the outlets 214 and 215 to the central area C changes its course toward the less airtight ends of the developer roller 121, such that the developer roller 121 collects the air supplied to the central area C (e.g., in a space adjacent the developer roller 121) during such change of direction, and further prevent or inhibit toner contamination at the end(s) of the developer roller 121 and/or at the end(s) of the photosensitive drum 40.

Each of the outlets 214, 215 may be provided at the upstream side of the position A and at the downstream side of the layer regulation member 104 to more efficiently collect scattered toner contained in the air returned to the upstream side of the position A through the first and second air flow passages F1 and F2.

In some examples, the outlet 214 and the outlet 215 may be formed as a common outlet so as to partially overlap with each other within a range, thus preventing or inhibiting the aforementioned toner contamination at the end of the developer roller 121 and the end of the photosensitive drum 40. In some examples, the common outlet may be provided at the central area C in the longitudinal direction of the developer roller 121. In some examples, the common outlet may be positioned entirely within the central area C in the longitudinal direction of the developer roller 121.

Figure 6:
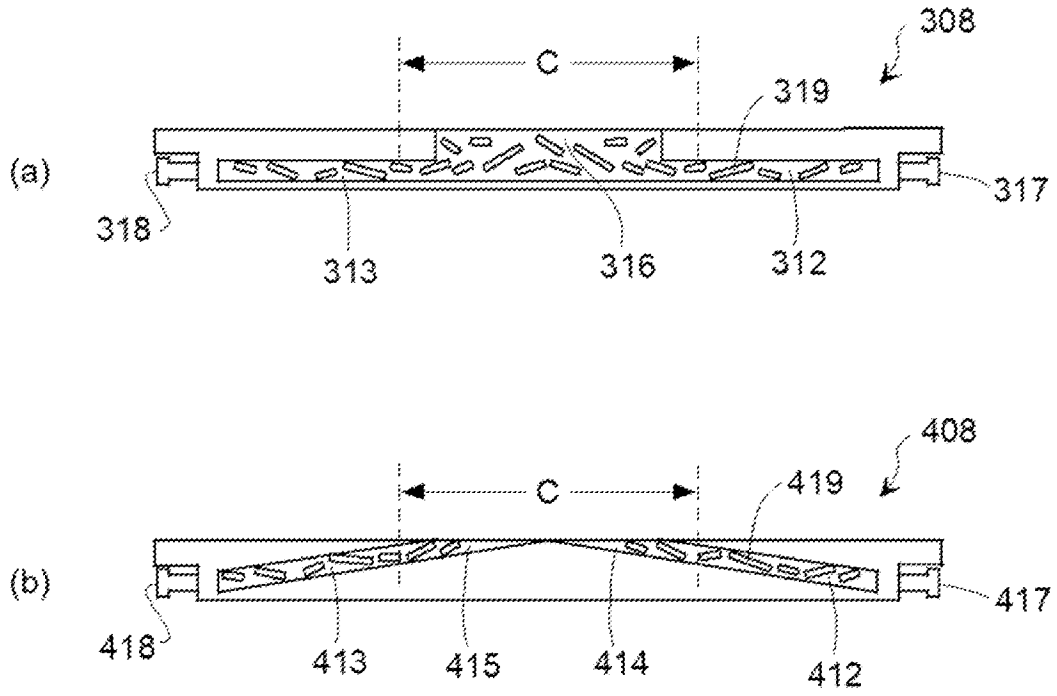
FIG. 6 part (a) is a schematic diagram of an example flow passage member.

With reference to FIG. 6 part (a), the developing device 120 may include a flow passage member (or flow passage forming member) 308. The example flow passage member 308 includes one or more protrusions 319 on the internal surfaces of a first outlet passage 312 and a second outlet passage 313 to generate turbulence. The protrusion 319 lowers the speed of the air directed to the developer roller 121 through the first and the second outlet passages 312, 313 to cause the developer roller 121 to more efficiently collect (e.g., in a space adjacent the developer roller 121), the toner contained in the air returned to the upstream side of the position A. In some examples, the protrusion 319 may be provided on the internal surface of at least one of the first outlet passage 312 and the second outlet passage 313. Components of the flow passage member 308 that substantially correspond to components of the flow passage member 108 described with reference to FIG. 4 part (a) and 4 part (b) are denoted by the reference signs obtained by adding "200" to the reference signs of the components of the flow passage member 108 described with reference to FIGS. 4(*a*) and 4(*b*). For example, the first outlet passage 312 has an inlet 317 that substantially corresponds to the inlet 117 of the flow passage member 108, the second outlet passage 313 has inlet 318 that substantially corresponds to the inlet 118 of the flow passage member 108, and the flow passage member 308 includes an outlet 316 that substantially corresponds to the outlet 116.

With reference to FIG. 6 part (b), the developing device 120 can include a flow passage member (or flow passage forming member) 408. The example flow passage member 408 includes one or more protrusions 419 on the internal surfaces of a first outlet passage 412 and a second outlet passage 413 to generate turbulence. The protrusion 419 may lower the speed of the air directed to the developer roller 121 through the first and second outlet passages 412, 413, and cause the developer roller 121 to more efficiently collect (e.g., in a space adjacent the developer roller 121), the toner contained in the air returned to the upstream side of the position A. In some examples, the protrusion 419 may be provided on the internal surface of at least one of the first outlet passage 412 and the second outlet passage 413. Components of the flow passage member 408 that substantially correspond to the components of the flow passage member 208 are denoted by the reference signs obtained by adding "200" to the reference signs of the components of the flow passage member 208 described with reference to FIG. 5 part (a) and FIG. 5 part (b). For example, the first outlet passage 412 has an inlet 417 substantially corresponding to the inlet 217, and an outlet 414 substantially corresponding to the outlet 214 of the flow passage member 208. In addition, the second outlet passage 413 has an inlet 418 substantially corresponding to the inlet 218, and an outlet 415 substantially corresponding to the outlet 215 of the flow passage member 208.

Figure 7:
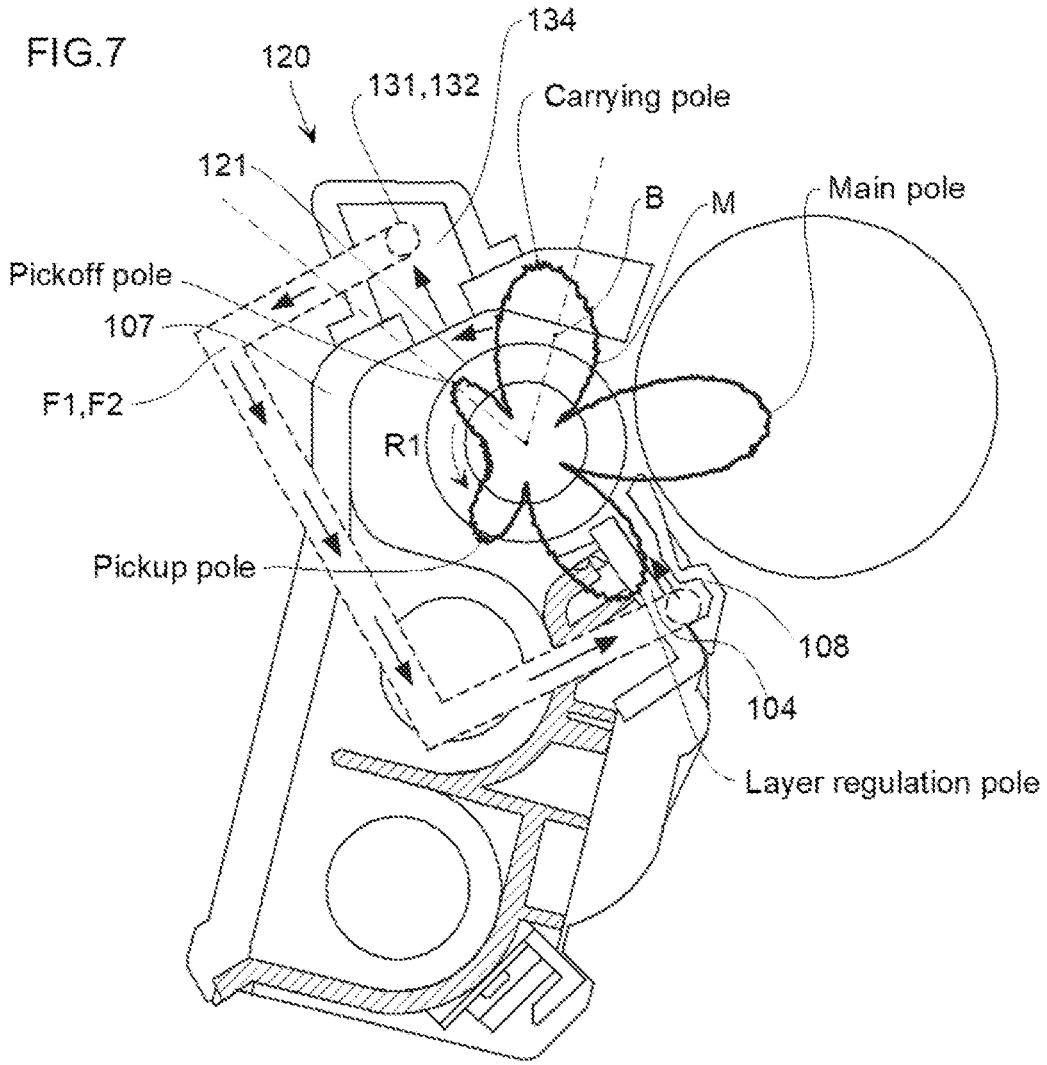
FIG. 7 is a schematic diagram of the example developing device of FIG. 2, illustrating magnetic poles of the example developer roller.

FIG. 7 schematically illustrates a magnetic force component M (shown in thick solid line) generated around the developer roller 121 in the example developing device 120 shown in FIG. 2 along with various magnetic poles (peak positions of magnetic force component). In some examples, the inlet of the first air flow passage F1 (e.g., the hole 134) may be provided at a downstream side of the position B and at an upstream side, in a rotation direction R1 of the developer roller 121, of the pickoff pole (hereinafter referred to as "upstream side of the pickoff pole"). Similarly, the inlet of the second air flow passage F2 (e.g., the hole 134) may be provided at a downstream side of B and at an upstream side of the pickoff pole. During operation of the developing device 120, the internal pressure of the container 107 may tend to become higher when approaching, and even higher when reaching, the upstream side of the pickoff pole, in the rotation direction R1 of the developer roller 121. Accordingly, the inlets of the first and second air flow passages F1 and F2 (e.g., the holes 134) are positioned, to draw the air out from a relatively high pressure area in the container 107, to better reduce the internal pressure of the container 107.

While FIG. 3 illustrate example routes of the first and second bypass passages B1 and B2, the routes of the first and second bypass passages B1 and B2 are not limited to those shown in FIG. 3. For example, the first and second bypass passages B1 and B2 may be formed according to other example routes that cooperate with the functions of other components of the developing device 120. In addition, the first and second bypass passages B1, B2 illustrated in FIG. 2 is coupled to the container 107 via the exhaust duct S1, according to an example. In other examples, the first and the second bypass passages B1, B2 may be directly coupled to respective ends of the longitudinal container 107 of the developer roller 121. In further examples, the first and second bypass passages B1 and B2 may be integrally formed with the container 107.

In FIG. 4 part (b) and FIG. 5 part (b), the example layer regulation member 104 is used to form various outlet passages to reduce the size of the developing device 120. In other examples, the layer regulation member 104 may be replaced with another flow passage member to form the outlet passages thereof. Also, the outlet passages formed on the side of the flow passage members 108, 208 illustrated in FIG. 4 part (a) and FIG. 5 part (a) may be varied to form other example patterns, and may be further positioned on the side of the layer regulation member 104, or on the side of such other flow passage member replacing the layer regulation member 104.

Figure 8:
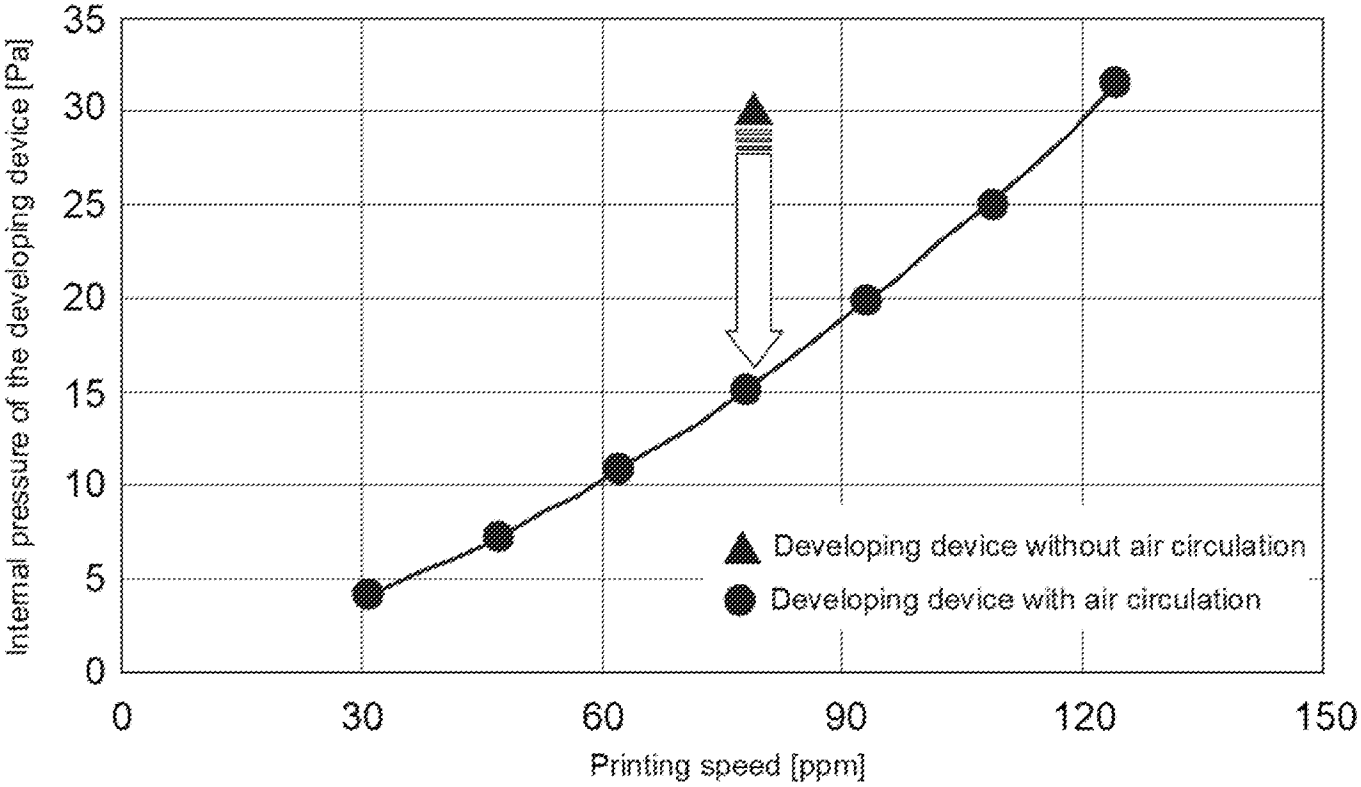
FIG. 8 is a graph illustrating a relationship of printing speed, relative to the internal pressure of the developing device for an example developing device with air circulation and for a comparative developing device without air circulation.

FIG. 8 is a graph showing the internal pressure of the developing device measured under the same condition for an example developing device with air circulation and for a developing device without air circulation, according to a comparative example. According to the graph, when the printing speed is about 78 ppm, the internal pressure in the example developing device with air circulation drops to about half of the internal pressure of the developing device without air circulation.

Figure 9:
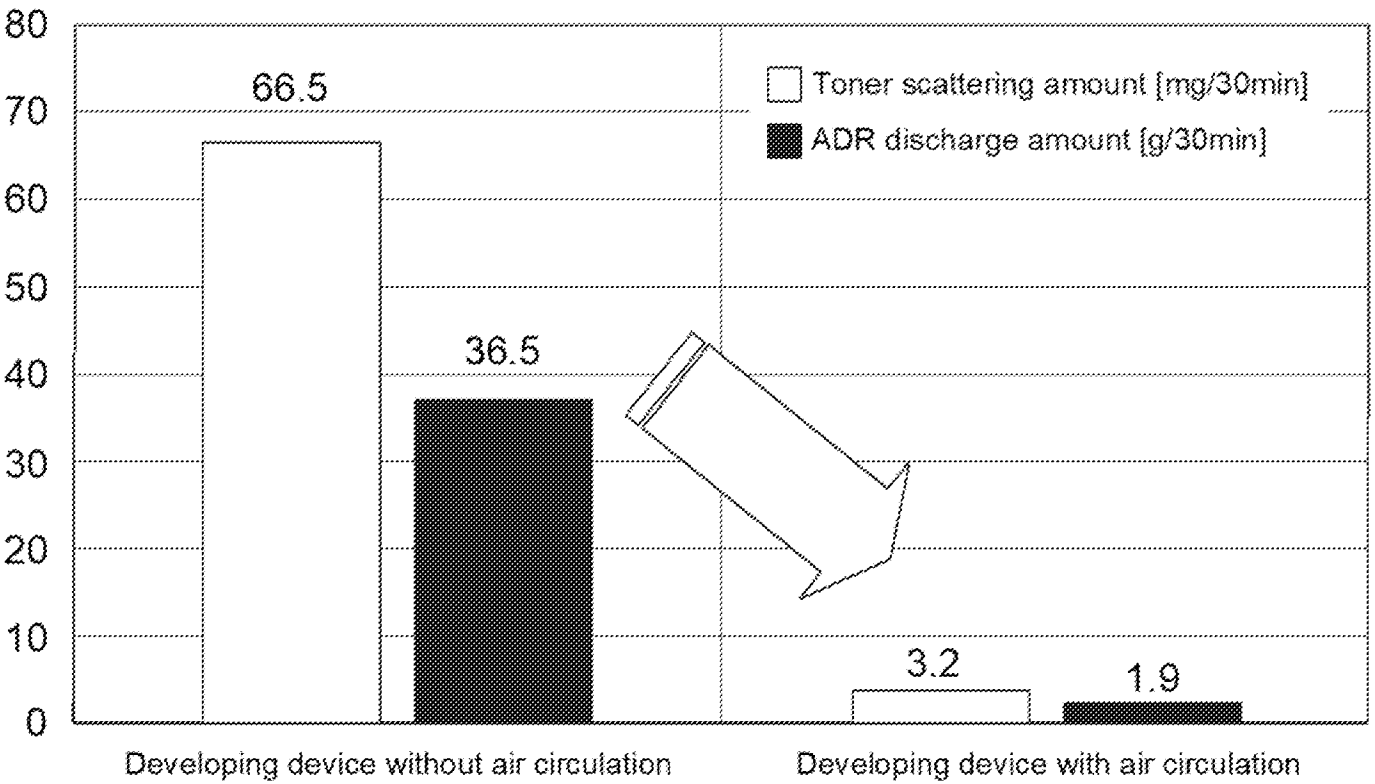
FIG. 9 is a graph showing the toner scattering amount and the amount of ADR (Auto Developer Refill) discharge for an example developing device with air circulation and a comparative developing device without air circulation.

FIG. 9 is a graph illustrating the toner scattering amount and Auto Developer Refill (ADR) discharge amount (excessive discharge amount of the developer from the ADR discharge port associated with the rise in internal pressure of the container) measured under the same condition for an example developing device with air circulation and for a developing device without air circulation. The "toner scattering amount" may refer to an amount of scattered toner measured at a predetermined position in the housing of the image forming apparatus during the operation of the developing device. The "ADR discharge amount" may refer to an excessive discharge amount of the developer measured near the ADR discharge port during the operation of the developing device. Based on the graph of FIG. 9, the toner scattering amount and ADR discharge amount of the example developing device with air circulation are both significantly lower than the toner scattering amount and ADR discharge amount of the developing device with air circulation.

It is to be understood that not all aspects, advantages and features described herein may necessarily be achieved by, or included in, any one particular example. Indeed, having described and illustrated various examples herein, it should be apparent that other examples may be modified in arrangement and detail is omitted.

The invention claimed is:

1. A developing device with air circulation, comprising:
a container having an opening, the container extending in a longitudinal direction;
a developer roller disposed within the container to supply toner to a photosensitive body through the opening; and
an air flow passage to receive air from inside of the container and to supply the air, via an end of the container in the longitudinal direction, to an upstream side of a closest position between the developer roller and the photosensitive body, in a rotation direction of the developer roller,
wherein the air flow passage has an outlet that is aligned with a central area in the longitudinal direction of the developer roller.

2. The developing device of claim 1, wherein the outlet is open toward the developer roller, and wherein a portion of the air flow passage adjacent the outlet is inclined relative to the longitudinal direction of the developer roller, and extends toward the central area the developer roller.

3. The developing device of claim 1, wherein the air flow passage includes an outlet passage to conduct the air supplied via the end of the container to the outlet, and wherein the outlet passage has an internal surface that includes one or more protrusions.

4. The developing device of claim 1, comprising a layer regulation member that is spaced apart from the developer roller to form a gap between the layer regulation member and an outer peripheral surface of the developer roller, wherein the outlet is provided at an upstream side, in the rotation direction of the developer roller, of the closest position between the developer roller and the photosensitive body, and at a downstream side, in the rotation direction of the developer roller, of the layer regulation member.

5. The developing device of claim 4, wherein the air flow passage has an inlet communicated with the inside of the container, wherein the inlet is located at a downstream side, in the rotation direction of the developer roller, of a closest position between the developer roller and an inner wall of the container, and at an upstream side, in the rotation direction of the developer roller, of the layer regulation member.

6. The developing device of claim 5, wherein the inlet is located at an upstream side, in the rotation direction of the developer roller, of a pickoff pole of the developer roller.

7. A developing device with air circulation, comprising:

a container extending in a longitudinal direction, the container having a first end, a second end opposite the first end, and an opening between the first end and the second end;

a developer roller extending in the longitudinal direction and housed in the container to supply toner to a photosensitive body through the opening;

a first air flow passage to receive air from inside of the container and to supply the air, via the first end of the container, to an upstream side, in a rotation direction of the developer roller, of a closest position between the developer roller and the photosensitive body; and a second air flow passage to receive air from the inside of the container and to supply the air, via the second end of the container in the longitudinal direction of the developer roller, to the upstream side, in the rotation direction of the developer roller, of the closest position between the developer roller and the photosensitive body, wherein the first and second air flow passages have one or more outlet that is aligned with a central area in the longitudinal direction of the developer roller.

8. The developing device of claim 7, wherein the one or more outlet of the first air flow passage and of the second air flow passage is a common outlet.

9. The developing device of claim 7, wherein the one or more outlet includes a first outlet of the first air flow passage and a second outlet of the second air flow passage that is separate from the first outlet, and wherein at least the first air flow passage has a portion adjacent the first outlet that is inclined relative to the longitudinal direction of the developer roller, toward the central area.

10. The developing device of claim 7, wherein the first air flow passage includes a first outlet passage to conduct the air supplied via the first end of the container to the outlet, wherein the second air flow passage includes a second outlet passage to conduct the air supplied via the second end of the container to the outlet, and wherein at least one of the first and second outlet passages has an internal surface that includes one or more protrusions.

11. The developing device of claim 7, comprising a layer regulation member that is spaced apart from an outer peripheral surface of the developer roller, wherein the outlet is located at an upstream side, in the rotation direction of the developer roller, of the closest position between the developer roller and the photosensitive body, and at a downstream side, in the rotation direction of the developer roller, of the layer regulation member.

12. The developing device of claim 11, wherein the first air flow passage has a first inlet and the second air flow passage has a second inlet, wherein each of the first inlet and the second inlet communicates with the inside of the container and is located at a downstream side, in the rotation direction of the developer roller, of a closest position between the developer roller and an inner wall of the container, and at an upstream side, in the rotation direction of the developer roller, of the layer regulation member.

13. The developing device of claim 12, wherein each of the first inlet and the second inlet of the first and second air flow passages is located at an upstream side, in the rotation direction of the developer roller, of a pickoff pole of the developer roller.

14. The developing device of claim 11, comprising a flow passage member that extends in the longitudinal direction of the developer roller, wherein the layer regulation member extends in the longitudinal direction adjacent the flow passage member, wherein the first air flow passage includes a first outlet passage extending between the flow passage member and the layer regulation member, to the one or more outlet, and wherein the second air flow passage includes a second outlet passage extending between the flow passage member and the layer regulation member, to the one or more outlet.

15. The developing device of claim 14, wherein the flow passage member has a first end and a second end opposite the first end, wherein the first outlet passage extends from the first end of the flow passage member to the one or more outlet, and wherein the second outlet passage extends from the second end of the flow passage member to the one or more outlet.

* * * * *